US005531233A

United States Patent [19]

Oglesby et al.

[11] Patent Number: 5,531,233

[45] Date of Patent: Jul. 2, 1996

[54] METHOD OF AND APPARATUS FOR APPLYING ADHESIVE TO CIGARETTE PAPER AND THE PAPER AND CIGARETTE PRODUCED THEREBY

[75] Inventors: Robert L. Oglesby, Kernersville; Leigh A. B. Smith, Pfafftown; Larry S. Jordan, Lexington; Carl C. Greene, Jr., Winston-Salem; Wayne E. Leonard, Sr., Pinnacle, all of N.C.

[73] Assignee: R. J. Reynolds Tobacco Company, Winston-Salem, N.C.

[21] Appl. No.: 263,576

[22] Filed: Jun. 22, 1994

[51] Int. Cl.[6] ..... A24C 5/24

[52] U.S. Cl. ..... 131/69; 131/35; 131/365; 118/50

[58] Field of Search ..... 131/35, 69, 90, 131/365, 374, 375; 118/50

[56] References Cited

U.S. PATENT DOCUMENTS

| | | | |
|---|---|---|---|
| 2,543,277 | 2/1951 | Copeman | 131/69 X |
| 3,977,358 | 8/1976 | Stroobants | 118/50 X |
| 3,989,001 | 11/1976 | Brigham et al. | 118/50 X |
| 4,326,543 | 4/1982 | Martin et al. . | |
| 4,434,805 | 3/1984 | Hall . | |
| 4,575,368 | 3/1986 | Sagawa et al. | 131/69 X |
| 4,715,388 | 12/1987 | Rainer . | |
| 4,785,831 | 11/1988 | Hinchcliffe et al. . | |
| 5,144,965 | 9/1992 | Southwick | 131/365 X |
| 5,222,509 | 6/1993 | Imai et al. | 131/69 |

FOREIGN PATENT DOCUMENTS 2243983 11/1991 United Kingdom .

*Primary Examiner*—Jennifer Bahr

[57] ABSTRACT

An adhesive spray delivery apparatus and a method of applying a predetermined quantity of anchoring adhesive in a predetermined spray pattern to an advancing web of cigarette paper are disclosed. The apparatus includes a pressurized spray system under control of a programmable controller for precisely and uniformly applying the adhesive in an atomized spray to the advancing cigarette paper, thereby eliminating the need to increase the density of the tobacco rod at discrete intervals of the rod to compensate for a significant volume of loose ends. The apparatus is portable and may be retrofitted to existing cigarette makers.

29 Claims, 2 Drawing Sheets

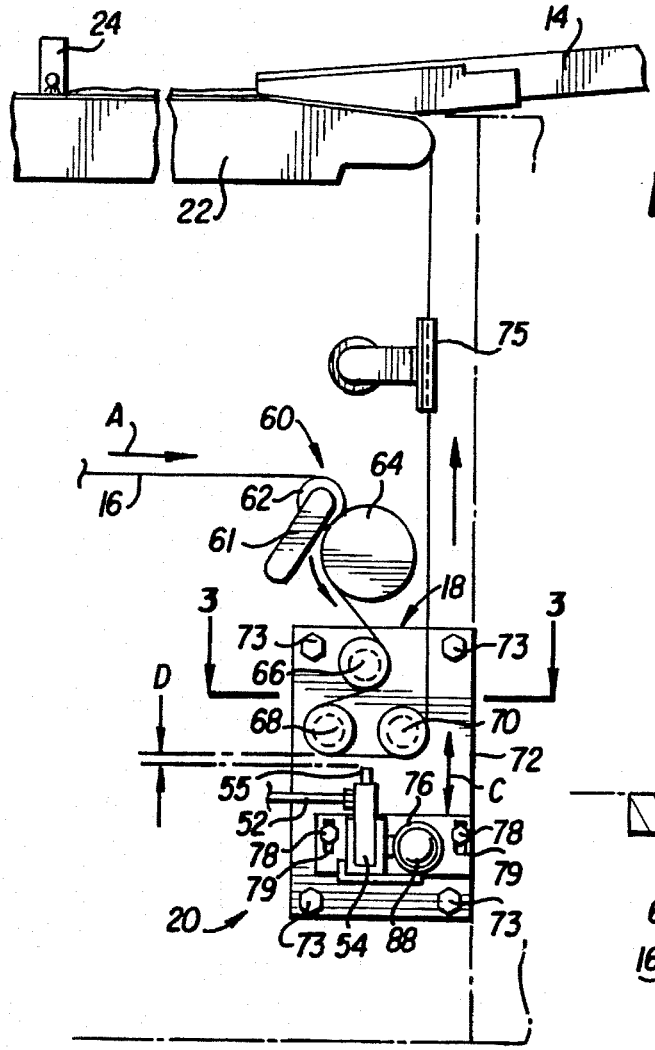
FIG. 2
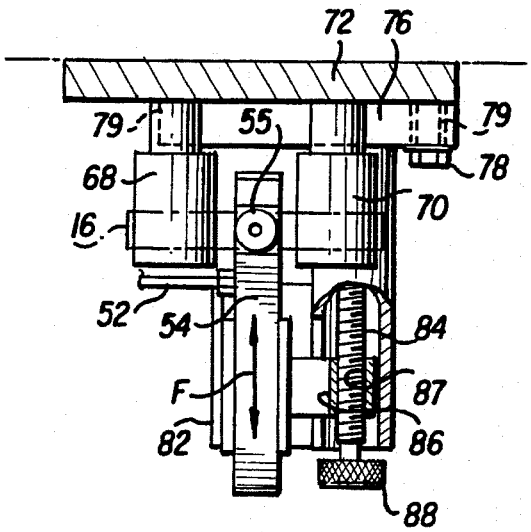
FIG. 3
FIG. 4
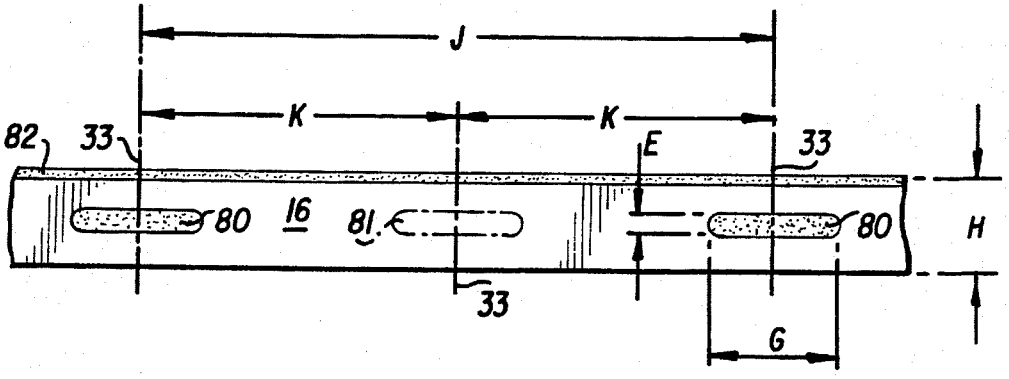

METHOD OF AND APPARATUS FOR APPLYING ADHESIVE TO CIGARETTE PAPER AND THE PAPER AND CIGARETTE PRODUCED THEREBY

FIELD OF THE INVENTION

The present invention relates to the manufacture of cigarettes, and more particularly to a method of and an apparatus for uniformly and precisely applying an anchoring glue to wrapping paper used in the manufacture of tobacco rods for smoking articles, such as cigarettes, and the cigarette and wrapping paper produced thereby.

BACKGROUND OF THE INVENTION

In the cigarette making art, there is a tendency for small particles or strips of tobacco to fall out of the ends of tobacco rods ("loose ends") during the handling, packaging and shipping associated with the manufacture of production cigarettes, and during handling by retailers and distributors as well as by the consumer. In fact, the loss of tobacco resulting from such loose ends has been measured to exceed 16% on a weight-based average. One method for minimizing loose ends requires the introduction of an additional quantity of tobacco in the cigarette filler stream at predetermined spaced intervals along the longitudinal extent of the nascent tobacco rod. An adhesive is applied to a longitudinal edge of the cigarette wrapping paper into which the stream of tobacco filler is deposited, the cigarette paper then being wrapped about the tobacco filler with the adhesive-applied edge overlapping the opposite paper edge and containing the tobacco filler in a continuous rod-like shape. The resulting increased density of tobacco filler located at those predetermined spaced intervals coincides with the tobacco rod ends after cutting into individual tobacco rods during cigarette production. Each of the tobacco rod ends on either side of the cuts has an increased packing density of tobacco known as a "dense end." Such dense ends tend to reduce the undesired loss of tobacco during handling of the tobacco rod during manufacture and subsequent handling of the cigarettes.

While this provides an acceptable solution to the "loose end" problem, the value of this approach is compromised from a cost standpoint by reason of the requirement for additional tobacco to create the dense end. It is also known that a dense end of a tobacco rod in which the tobacco is overly compacted will restrict the flow rate of tobacco smoke through the cigarette when used as intended, thereby undesirably increasing the draw resistance encountered by the smoker at the beginning of the smoke and giving the smoker the perception of a poor or inconsistent product.

Various other approaches have been taken to reduce loose ends in tobacco rods. U.K. Patent Application No. 2 243 983, for example, discloses a method and apparatus for forming a cigarette having adhesive applied in strips by a print wheel along one longitudinal edge of the wrapping paper and at spaced longitudinal locations across the entire transverse dimension of the paper from that edge. The cigarette paper is then wrapped about the stream of tobacco filler deposited thereon and the longitudinal adhesive strip is secured to the opposite edge of the paper. Each transverse adhesive strip forms an adhesive annulus about the entire inner circumference of the formed tobacco rod. The tobacco rod is then transversely cut at the midpoint of each transverse adhesive strip and at the midpoints between the strips to form tobacco rods with an annular adhesive band at the inner surface of the free end of each tobacco rod to prevent "loose ends."

According to an alternative embodiment of the apparatus, the adhesive is applied to the cigarette paper by a blast of air which is directed against a screen carrying a liquid adhesive to cause the adhesive to be thrown against the cigarette paper. A shaft-mounted disk rotating at a predetermined speed in synchronization with the advancing cigarette paper includes a window through which the air blast is directed at those time intervals corresponding to the rotational speed of the disk. An important problem with this arrangement is overspray inherent in the operation of this apparatus, thereby limiting precise and uniform application of the adhesive to the cigarette paper. Another problem is the relatively limited speed of tobacco rod production based on a relatively slow rotational speed of the disk, that speed being necessarily limited to enable the passage of a blast of air through the disk window where it impinges on the adhesive-carrying screen and ejects the adhesive therefrom onto the cigarette paper.

U.S. Pat. Nos. 4,715,388 and 4,785,831 disclose other methods and apparatus for minimizing the loose ends of cigarettes, for instance, by incorporating into the tobacco filler a hygroscopic powder that becomes tacky upon absorption of moisture or by applying a foamed adhesive to the free ends of the cigarettes after manufacture. The latter method and apparatus suffer from similar deficiencies as other prior art apparatus in that it is not capable of operating at the high production rates associated with modern cigarette making machinery. The former method creates the possibility of undesirably staining the cigarette paper with powder particles that contact that paper.

In view of the foregoing deficiencies of the prior art methods and apparatus, it would be desirable to provide a method of and an apparatus for minimizing loose ends of cigarettes that is capable of operating at the production speeds of modern cigarette manufacturing machinery. In particular, it would be desirable to provide a method of and apparatus for minimizing loose ends of cigarettes that is capable of being used during the cigarettes manufacturing process on existing machines capable of production speeds of 8000 cigarettes or more per minute.

SUMMARY OF THE INVENTION

It is, therefore, a primary objective of the present invention to fulfill a need in the art to provide a method of and an apparatus for minimizing loose ends of smoking articles, such as cigarettes, at production rates of 8000 cigarettes or more per minute per line. That objective is fulfilled according to the present invention by providing a method of and an apparatus for precisely and rapidly applying an anchoring adhesive to an advancing cigarette paper just prior to depositing the tobacco filler onto the paper.

It is another object of the present invention to provide a method for and an apparatus for precisely and uniformly applying a predetermined spray pattern of anchoring adhesive onto a selected transverse location of an advancing web of cigarette paper used in the manufacture of tobacco rods.

Another object of the present invention is to spray an anchoring adhesive pattern onto an advancing web of cigarette paper used in the manufacture of tobacco rods such that the area and location of the adhesive reduces loose ends while minimizing the amount of adhesive necessary to do so.

Yet another object of the present invention is to provide an alternative method for minimizing loose ends so as to permit less dense packing of tobacco rods.

Still a further object of the present invention is to provide an apparatus for minimizing loose ends by precisely and uniformly applying an anchoring adhesive to an advancing web of cigarette paper, which apparatus is universally adaptable to cigarette maker apparatus commonly known and used in the art.

Another object of the invention is to provide a cigarette wrapping paper having an anchoring adhesive applied thereto for minimizing loose ends.

Still another object of the invention is to provide cigarettes with reduced loose ends and having a substantially uniform density from end-to-end.

The present invention is a method of and apparatus for uniformly and precisely applying a predetermined small quantity of anchoring adhesive in a predetermined spray pattern to an advancing web of cigarette paper used in the manufacture of tobacco rods for cigarettes.

According to the apparatus aspects of the invention, the apparatus comprises an adhesive application system which may be portable and retrofittable to existing cigarette machines. The system comprises a high speed spray applicator which is mounted to a cigarette maker upstream of a garniture adjacent the path of travel of the cigarette paper web to the garniture. A remotely located adhesive pump and regulated compressed air source supply adhesive to the spray applicator from a reservoir under control of a programmable controller. A current encoder positioned downstream of the garniture tracks the linear speed of the advancing tobacco rod and inputs this data to the programmable controller.

After being tracked for linear speed by the encoder, the tobacco rod advances further to a reciprocating cut-off knife for cutting off the advancing tobacco rod. Operation of the cut-off knife generates a trigger signal which is inputted to the programmable controller so that the cut-off knife signal controls the overall timing of the operation of the spray applicator system. The cut-off knife may be set for different lengths of tobacco rod to be cut.

The trigger signal generated by operation of the cut-off knife is received and processed by the programmable controller which commands operation of the pressurized anchoring adhesive spray applicator. The pump delivers a supply of liquid adhesive to a spray nozzle positioned in opposing relationship to the advancing web of cigarette paper. The adhesive pump is speed controlled by the cigarette maker and a solenoid and servo feedback system provide a controlled flow of liquid adhesive to the needle valve actuator which is atomized by the compressed air from the air source. The solenoid feedback system regulates pump pressure within a range of about 5 p.s.i. to about 18 p.s.i. It is also contemplated that the chosen spray adhesive can be a carrier for a flavorant for enhancing the taste of the first or lighting puff of the cigarette.

The cigarette paper is advanced around a pre-tensioner and three capstans affixed to the cigarette maker. The cigarette paper is further advanced along a horizontal path between the two bottom capstans in which the paper is held in opposing relationship to the vertically oriented spray nozzle which uniformly and precisely applies a predetermined quantity of anchoring adhesive in a predetermined spray pattern to the cigarette paper.

The spray nozzle is mounted for adjustment in the horizontal and vertical planes, thereby allowing for adjustment of a vertical distance between a discharge tip of the spray nozzle and the cigarette paper as necessary to achieve a desired spray pattern of the anchoring adhesive, i.e., to increase or decrease the width of the adhesive strip relative to the width of the paper. Preferably, the adhesive strip has a width substantially less than the paper width and is spaced from both edges of the paper so as to avoid overspray onto the surrounding components.

In accordance with the method aspects of the invention, the controller is programmed with specific spacing patterns obtained by programming start points and stop points relative to the desired length of the adhesive pattern and the selected length of the formed tobacco rod required for a particular cigarette of a predetermined length. Small, discrete quantities of the anchoring adhesive are periodically discharged under control of the controller through the needle valve and sprayed onto the advancing web of cigarette paper at preprogrammed time intervals, resulting in the deposit of spaced, elongate adhesive strips of a desired length. If the programmed spacing pattern does not occur at the desired location relative to the cut-off knife, an offset factor is entered into the controller to adjust the position of the cut to bifurcate the elongate adhesive strip into two substantially equal length strips.

Precise placement of the adhesive on the paper followed by uniform bifurcation of the strip at each cut-off line equalizes the quantity of anchoring adhesive on each tobacco rod end so as to uniformly minimize the quantity of loose ends. Preliminary test data has shown that losses due to rejects from the cigarette maker can be reduced from 30%–70% depending on the sensitivity of the reject setting. It has also been found that 20%–40% less loose tobacco will result when the standard Borgwaldt loose end test is performed on cigarettes made according to the present invention. The method and apparatus of the present invention can be used with cigarette makers which produce 8000 or more cigarettes per minute per line, which is substantially greater than the yield rate of about 3000 cigarettes per minute that is believed possible using the apparatus of the aforementioned UK 2 243 983.

With the foregoing and other objects, advantages, and features of the invention that will become hereinafter apparent, the nature of the invention may be more clearly understood by reference to the following detailed description of the invention, the appended claims, and to the several views illustrated in the drawings.

BRIEF DESCRIPTION OF THE DRAWINGS

FIG. 2 is a fragmentary side elevation view of the adhesive applicator of FIG. 1 showing the path of the cigarette paper past the adhesive application nozzle of the apparatus;

FIG. 3 is a cross-sectional view, partly broken, taken along line 3—3 of FIG. 2, showing details of the adjusting apparatus for selectively positioning the adhesive application nozzle in a direction transverse to the path of the advancing cigarette paper;

FIG. 4 is a fragmentary top plan view of a length of the cigarette paper after a quantity of anchoring adhesive has been sprayed thereon showing two adhesive patches longitudinally aligned along the central axis of the cigarette paper, and an additional adhesive strip applied to one longitudinal edge of the cigarette paper.

DETAILED DESCRIPTION OF THE INVENTION

Figure 1:
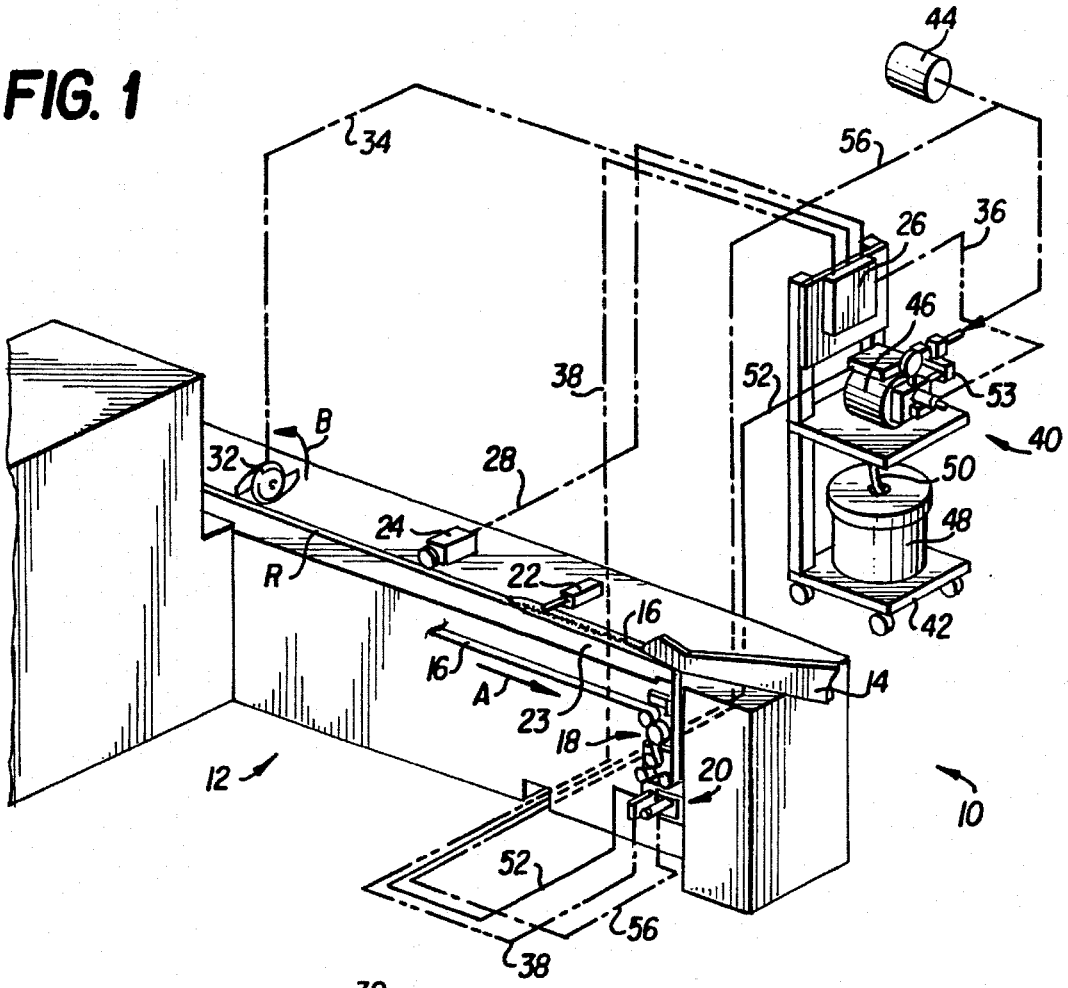
FIG. 1 is a perspective view of the adhesive-applying apparatus of the present invention, operatively connected to a conventional cigarette maker.

Referring now in detail to the drawings wherein like parts are designated by like reference numerals throughout, there is illustrated in FIG. 1 a perspective view of the adhesive application system of the invention which is designated generally by reference numeral 10. Only so much of the system 10 is shown in FIG. 1 as is necessary for a complete understanding of the present invention, it being understood that other conventional components of the cigarette maker are necessary for operation of the system 10. Depending on the type of cigarette maker machine to which the system 10 is applied, minor modifications to existing machine parts may be necessary to accommodate the apparatus of the present invention. Such modifications as are necessary will be apparent to a person skilled in the art in light of the teachings herein.

The adhesive application system 10 of the present invention is used in conjunction with a conventional cigarette maker 12, having a tobacco shower apparatus 14 for depositing a predetermined quantity or weight of tobacco onto a strip or web 16 of cigarette paper advancing in the direction of travel shown by arrow A. The cigarette paper 16 is advanced through a paper guide generally indicated by reference numeral 18 and past an adhesive applicator generally indicated by reference numeral 20. Following spray application of an anchoring adhesive to the cigarette paper 16 by applicator 20 in the manner to be more fully described below, a shower of tobacco filler is deposited onto the paper 16 at the tobacco shower apparatus 14. Adhesive is then applied to one edge of the paper 16 by means of a conventional adhesive applicator 22 after which the paper is wrapped about the tobacco in garniture 23 with its edges overlapping and the edge adhesive is cured or set to form a continuous tobacco rod R to be later cut into cigarettes of predetermined length or cut into lengths and assembled with filters to form complete filter cigarettes.

A current encoder 24 positioned downstream of the garniture 23 tracks the linear speed of the advancing tobacco rod R and inputs this data to a programmable controller 26 through line 28. Programmable controller 26 is preferably a Vansco Controller Model No. 99-07-44 manufactured by Vansco of South El Monte, Calif. 91733 and encoder 24 is preferably a Speed Tracker Model No. 99-07-45 also made by Vansco. The encoder 24 includes a rotatable tracking wheel 30 (FIG. 5) and is positioned in engagement with the drive belt of the maker. The wheel 30 tracks the linear speed of the rod on a 1:1 basis. In one revolution of the tracking wheel 30, the encoder produces a predetermined number of electronic pulses, e.g., 1200 pulses, correlating to a specific length of the tobacco rod. As will be more fully described below, accurate linear measurement of the advancing tobacco rod by the current encoder 24 permits a precise and uniform application of the anchoring adhesive to the cigarette paper 16.

After being tracked for linear speed by the encoder 24, the tobacco rod R advances to a cut-off knife 32 which rotates in a direction indicated by arrow B to transversely cut the advancing tobacco rod R along cutting path 33 of the cut-off knife 32. Operation of the cut-off knife 32 generates a trigger signal which is inputted to the programmable controller 26 through line 34. As will be appreciated by the skilled artisan, operation of the cut-off knife 32 of the cigarette maker 12 may be conventionally set to cut the tobacco rod R into different predetermined lengths of rod for use in making filtered or unfiltered cigarettes.

The trigger signal generated by operation of the cut-off knife 32 is received and processed by the controller 26 which controls operation of a pump for the anchor adhesive spray apparatus 40. Some components of the spray apparatus 40 are mounted on a transportable wheeled cart 42. Apparatus 40 also requires a regulated compressed air source 44 and a pump 46 for delivering a supply of liquid adhesive from a reservoir 48 via a first conduit 50 through a second conduit 52 to the spray applicator 20. The pump 46 is speed controlled by the controller and a solenoid and servo feedback system 53 to provide a controlled flow of liquid adhesive to a needle valve actuator 54 in a spray nozzle 55 (FIG. 2) off applicator 20. The adhesive is atomized at the spray nozzle 55 by the compressed air from the air source 44 (FIG. 2) which flows to the applicator 20 through a third conduit 56. The solenoid feedback system regulates pump pressure within the range of about 5 p.s.i. to about 18 p.s.i., although it will be understood that a greater or lesser delivery pressure may be used. A suitable liquid adhesive includes any commercially available modified starch or dextrin adhesive, ethylene vinyl acetate copolymer emulsions, or other suitable adhesives. It is also contemplated that the selected adhesive may function as a carrier for a flavorant for enhancing the taste of the first or lighting puff of the cigarette.

Now referring to FIGS. 2 and 3, the structure of the paper guide 18 and adhesive applicator 20 will be described. The cigarette paper 16 is advanced around a pre-tensioner 60 comprising an arm 61 with a roller 62 mounted on the end thereof and biased in the direction of a drive wheel 64 which rotates in the direction of the arrow. The paper 16 is then guided about capstans 66, 68, 70 mounted for rotation to a support plate 72 which is affixed to the cigarette maker 12 by bolts 73. According to this embodiment, the cigarette paper 16 advances along a horizontal path between capstans 68, 70 wherein the underside of the paper passes in opposing relation to the vertically oriented spray nozzle 55. The valve actuator 54 actuates the spray nozzle 55 to uniformly and precisely apply a predetermined quantity of anchoring adhesive in a predetermined spray pattern from spray nozzle 55 to the advancing web of cigarette paper 16. A preferred spray nozzle 55 is a Mini-Spray Applicator Nozzle Model No. A-2074 made by Vansco and a preferred valve actuator 54 is a High Speed Actuator Model No. 40-40-10 also made by Vansco. From paper guide 18 the paper 16 advances upwardly through a slotted guide 75 to garniture 23 (FIG. 2).

With reference to FIG. 4 there is shown the application of two anchoring adhesive patches 80 longitudinally aligned along the centerline of the cigarette paper 16, and an adhesive strip 82 applied to one longitudinal edge of the cigarette paper 16. The patches 80 are applied with spray nozzle 55 and the strip 82 is applied with conventional applicator 22 (FIG. 1). It will be understood by those skilled in the art that the depiction of the cigarette paper 16 in FIG. 4 represents the structure of the paper in a flat condition after application of adhesive strip 82 along the edge of the paper 16 by adhesive applicator 22. In most conventional cigarette maker, the longitudinal adhesive strip 82 is applied to the edge of the paper at or about the time the paper is formed into a tubular tobacco rod with the edges in overlapping relation.

The spray nozzle 55 is mounted to a bracket 76 which is adjustably affixed by a pair of threaded bolts 78 projecting through corresponding vertical slots 79 formed in the bracket 76 for securely affixing the bracket 76 to the support plate 72. The bracket 76 is adjustable in a vertical plane in the direction of arrow C, thereby allowing for adjustment of the vertical distance D between the tip of spray nozzle 55 and the horizontal plane of cigarette paper 16 passing between capstans 68 and 70. Such adjustment is provided to achieve a desired spray pattern of the anchoring adhesive, i.e., to increase or decrease the width of the elongate strips 80 in the width dimension E shown in FIG. 4. Preferably, the discharge tip of spray nozzle 55 is adjusted to a vertical distance of about 6 mm from the cigarette paper 16, with a preferred range of 3–10 mm and a most preferred range of 4–8 mm from the paper 16. At a vertical distance of about 6 mm the width dimension E of the adhesive patches 80 is about 5–6 mm. This is the preferred width for a cigarette paper having a width of about 27 mm. (FIG. 4).

The spray nozzle 55 is also supported in a housing 82 mounted for adjustment in a horizontal plane forward and away from the plate 72 and bracket 76 by a rotatable screw 84 threadably engaged with a follower 86 having a threaded bore 87. The perpendicular or transverse position of the spray nozzle 55 relative to the longitudinal axis of the advancing cigarette paper 16 is adjusted by rotating the knurled knob 88 formed on the end of screw 84. Accordingly, the housing 82 and the spray nozzle 55 with the valve actuator 54 are adjustable in the direction of arrow F (FIG. 3). Although FIG. 4 shows the resulting anchor adhesive patches 80 extending along the centerline or median of the cigarette paper 16, it will be appreciated by the skilled artisan that the valve actuator 54 and spray nozzle 55 may be adjusted vertically and/or horizontally to cause an anchor adhesive patch of a desired transverse width E to be sprayed at a desired transverse location relative to the longitudinal axis of the advancing web of cigarette paper 16.

Figure 5:
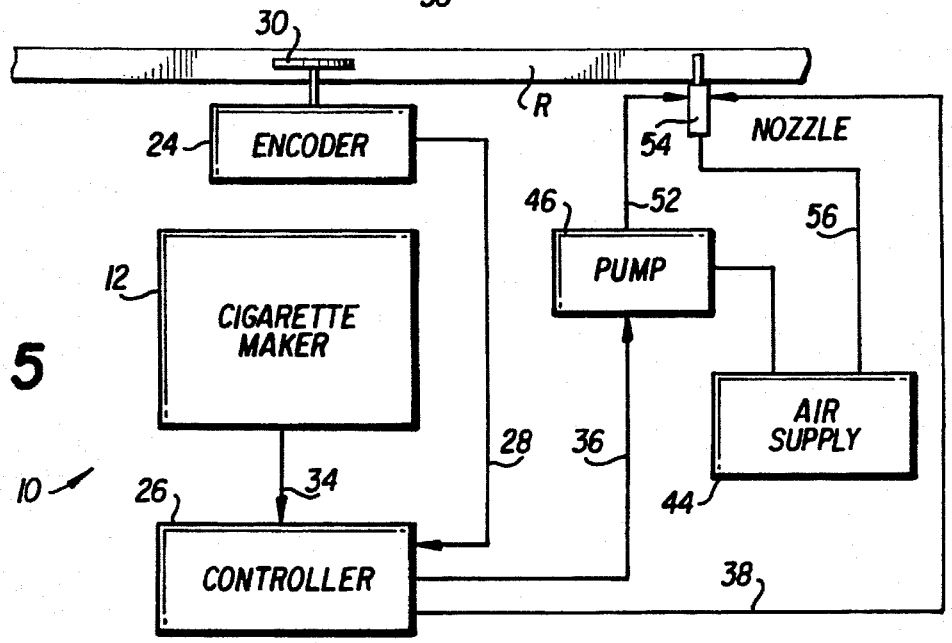
FIG. 5 is a schematic diagram of the major components of the adhesive application system of the invention.

The operation of the system 10 is further illustrated with reference to FIGS. 4 and 5, together with a description of the programming of the length and spacing patterns of the anchor adhesive in the direction of advance of the cigarette paper 16. More particularly, the controller 26 is programmed with specific adhesive length and spacing patterns obtained by programming start points and stop points relative to the subsequent cut ends of the tobacco rod and the desired overall length of the tobacco rod required for a cigarette of a particular length. With particular reference to FIG. 4 and in accordance with the operation of the system 10, discrete quantities of the anchoring adhesive are discharged from spray nozzle 55 under control of the controller 26 and valve actuator 54 onto the advancing cigarette paper 16 for a preprogrammed time period and at preprogrammed intervals. This operation results in the deposit of evenly distributed, elongate adhesive strips 80 having a length indicated by arrow G and a dimension J between the centers of adjacent strips 80. Dimension J is equal to the length of two cut tobacco rods of length K. Preferably, the elongate strips 80 have a longitudinal dimension in the range of about 24–40 mm, and a more preferred longitudinal dimension of about 32 mm from the leading edge to the trailing edge.

Typically, the arrangement or pattern of adhesive patches 80 would be used in making filter cigarettes wherein filters would be subsequently attached to tobacco rods of length at the cut line 33 midway between the adhesive patches 80. In the case of unfiltered cigarettes, additional adhesive patches 81 (shown in phantom lines in FIG. 4) are preferably disposed at the cut lines 33 between each adjacent pair of patches 80 so that both ends of the tobacco rods of length K will be treated with adhesive. This pattern will minimize loose ends at both ends of the unfiltered cigarette. Adhesive patches 81 could also be used for filter cigarettes if it were desired, for example, to prevent loose ends of the tobacco rod during processing prior to affixing a filter to one end of each tobacco rod.

Operation of the system 10 is initiated upon receipt of a signal from the cut-off knife 32 which is transmitted to the controller 26 via line 34. An electrical signal is sent from the controller 26 via lines 36 and 38 to activate the pump 46 and the valve actuator 54. Simultaneously, a signal is sent by the controller 26 to another solenoid (not shown) to activate the compressed air source 44 necessary to atomize the anchor adhesive at spray nozzle 55. If the programmed location of the elongate strips 80 (or 80 and 81) is not at the desired position relative to the cut-off knife 32, an offset factor is entered into the controller 26 to adjust the position of the elongate strips 80 (or 80 and 81) so that the cut-off knife 32 cuts the tobacco rod R along each cut line 33.

Precise placement of the adhesive patches 80 (or 80 and 81) on the tape 16 relative to one another and to the cut-off intervals results in a uniform bifurcation at the cut-off lines 33 such that the quantity and distribution of anchoring adhesive at each cut end is equal, thereby minimizing the loose ends of the cut tobacco rods and eliminating the need to increase the density of the tobacco rod at the free ends thereof.

It has been discovered according to the present invention that it is not necessary to provide a complete annular band of adhesive on the inner circumference of the cigarette paper at the free end of the tobacco rod to substantially minimize cigarette loose ends. A circumferential strip of only about 5–6 mm or about 20% or less of a total circumference of about 27 mm has been found substantially equivalent to providing a complete annular band especially when the length of the adhesive strip is 2–3 times its width. Such a relatively narrow elongated adhesive strip is particularly advantageous since it substantially eliminates any overspray that would inevitably result if the adhesive were applied from edge to edge of the paper as the prior art teaches.

Although a certain preferred embodiment of the invention has been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. In a cigarette maker having a garniture for forming a continuous rod of tobacco and means for cutting said rod of tobacco into rods of a predetermined length, an apparatus for applying an adhesive to a strip of cigarette wrapping paper on the cigarette maker, said apparatus comprising:

a source of adhesive;

a spray nozzle having a needle valve, said nozzle being located upstream of said garniture in opposing relation to said strip of cigarette wrapping paper, said strip of wrapping paper having a longitudinal axis;

means for moving said spray nozzle toward and away from said strip of wrapping paper;

means for moving said spray nozzle transversely relative to the longitudinal axis of said strip of wrapping paper;

a valve actuator for intermittently actuating the needle valve of said nozzle to spray adhesive on said strip of paper;

means connected between said adhesive source and said spray nozzle for supplying adhesive to said spray nozzle; and a controller connected between said cutting means and said valve actuator for operating said actuator in response to the cutting of said continuous rod of tobacco.

2. The apparatus of claim 1, wherein said cutting means is operable to cut said continuous rod of tobacco into said tobacco rods of predetermined length at a rate in excess of 3000 rods of predetermined length per minute.

3. The apparatus of claim 1, wherein said controller is programmable with start and stop points relative to alternating cuts of the tobacco rod by said cutting means.

4. The apparatus of claim 1, including means for tracking the linear speed of the continuous rod of tobacco, said tracking means having an output proportional to the linear speed of the continuous rod of tobacco, said output being connected to said controller, said controller controlling the intermittent actuation of said valve actuator in response to the output of said tracking means.

5. The apparatus of claim 1, wherein said means for supplying adhesive to the spray nozzle comprises a pump and including a source of pressurized air connected to said spray nozzle for atomizing the adhesive for application to said paper strip.

6. In a cigarette maker having a garniture for forming a continuous rod of tobacco and means for cutting said continuous rod of tobacco into tobacco rods of a predetermined length at a rate in excess of 3000 rods of predetermined length per minute, said cutting means including means for producing a cut-off output signal in response to the cutting of said continuous rod of tobacco, an apparatus for applying adhesive to a strip of cigarette wrapping paper having a longitudinal axis on the cigarette maker, said apparatus comprising:

a source of adhesive;

an adhesive applicator connected to said adhesive source and being operable to apply a discrete adhesive strip to said paper strip;

means for tracking the linear speed of the continuous rod of tobacco and for producing a speed output signal proportional to said linear speed;

a controller connected to said cutting means and said tracking means for receiving said cut-off and speed output signals and for controlling the operation of said adhesive applicator in response to said output signals to apply a plurality of said discrete adhesive strips to said paper strip in a predetermined pattern along the longitudinal axis of said paper strip.

7. The apparatus of claim 6, wherein said adhesive applicator includes a spray nozzle having a needle valve, said nozzle being located upstream of said garniture in opposing relation to said strip of cigarette wrapping paper, a valve actuator for actuating the needle valve of said nozzle to spray adhesive on said strip of paper, and pump means connected between said adhesive source and said spray nozzle for supplying adhesive to said nozzle.

8. The apparatus of claim 6, wherein each adhesive strip has a width less than the transverse dimension of the cigarette wrapping paper relative to the longitudinal axis of said paper strip.

9. The apparatus of claim 8, wherein each adhesive strip is substantially centered with respect to the longitudinal axis of said paper strip.

10. The apparatus of claim 8, wherein each adhesive strip has a width of about 20% or less of the width of the cigarette wrapping paper and a length of about 2–3 times the width of the adhesive pattern.

11. A method of applying an adhesive to a strip of cigarette wrapping paper having a central longitudinal axis and formed by a cigarette maker having a garniture into a continuous rod containing tobacco filler, said rod having a linear speed, comprising the steps of:

advancing the paper strip through a first adhesive application station located upstream of the garniture, said first adhesive application station including a spray nozzle with a needle valve;

tracking the linear speed of said continuous rod and producing a speed output signal proportional to said linear speed;

cutting said continuous rod into a plurality of tobacco rods of a predetermined length and producing a cut-off output signal in response to the cutting of said continuous rod; and actuating the needle valve of the spray nozzle in response to said speed and cut-off signals to spray a plurality of discrete adhesive strips onto said paper strip, said adhesive strips extending across at least some of the locations at which the cuts are subsequently made in said continuous tobacco rod.

12. The method of claim 11, including the step of applying a second adhesive strip to a longitudinal edge of said paper strip at a second adhesive application station downstream of said first adhesive application station.

13. The method of claim 11, including the step of positioning said spray nozzle in relation to said paper strip such that said discrete adhesive strips have a width transverse to the longitudinal axis of said paper strip less than the width of said paper strip and are located substantially along the central longitudinal axis of said paper strip.

14. The method of claim 11, including the step of spraying said adhesive strips so as to extend across alternating cuts in said continuous tobacco rod.

15. The method of claim 11, including the step of spraying said adhesive strips so as to extend across each cut in said continuous tobacco rod.

16. A cigarette wrapping paper for forming tobacco rods having reduced loose ends comprising a web of paper having two longitudinal edges, a predetermined width between said edges and an indeterminate length, a first continuous adhesive strip applied along one of said longitudinal edges and a plurality of second spaced adhesive strips applied to said paper along only one longitudinal axis spaced from the longitudinal edges of said paper, said second adhesive strips having a width less than the predetermined width of said paper and being spaced from both longitudinal edges of said paper, said second adhesive strips having a length along the longitudinal extent of the paper, the dimension between the midpoints of the lengths of adjacent second adhesive strips being substantially equal to the length of two tobacco rods.

17. The cigarette wrapping paper of claim 16, wherein the width of said second adhesive strips is about 20% or less of the width of said paper web.

18. The cigarette wrapping paper of claim 16, wherein the length of each of said second adhesive strips is about 2–3 times its width.

19. The cigarette wrapping paper of claim 16, wherein the paper web has a width of about 27 mm, said second adhesive strips having a width of about 5–6 mm and a length of about 24–40 mm.

20. The cigarette wrapping paper of claim 16, wherein the adhesive of said second adhesive strips includes a flavorant.

21. A cigarette comprising a tobacco rod formed of a cigarette paper having longitudinal edges and being wrapped about a tobacco filler such that an inner circumferential surface thereof confronts said tobacco filler, said tobacco rod having at least one free end, a longitudinal adhesive strip sealing the longitudinal edges of said cigarette paper together and a transverse adhesive strip applied on the inner circumferential surface of the paper adjacent said one free end of the tobacco rod and extending around an arcuate circumferential portion of said inner circumferential surface less than the entire inner circumferential surface of said paper, the arcuate extent of said transverse adhesive strip being about 20% or less of the inner circumferential surface of said paper.

22. The cigarette of claim 21, wherein said tobacco rod has two free ends, a transverse adhesive strip being applied to the paper adjacent both free ends of the tobacco rod.

23. The cigarette of claim 21, including a filter attached at the other end of said tobacco rod opposite the free end thereof.

24. The cigarette of claim 21, wherein the dimension of said transverse adhesive strip along the length of said tobacco rod is about 2–3 times its arcuate extent.

25. The cigarette of claim 21, wherein the arcuate extent of said transverse adhesive strip is about 5–6 mm.

26. A cigarette maker comprising:

a garniture for forming a continuous rod of tobacco;

means for cutting said rod of tobacco into rods of a predetermined length;

a source of adhesive;

a spray nozzle having a needle valve, said nozzle being located upstream of said garniture in opposing relation to a strip of cigarette wrapping paper having a central longitudinal axis and a transverse width;

a valve actuator for intermittently actuating the needle valve of said nozzle to apply adhesive on said paper strip, said adhesive being applied to said paper strip in a plurality of discrete adhesive strips, each adhesive strip having a width transverse to said paper strip less than the transverse width of said paper strip;

means connected between said adhesive source and said spray nozzle for supplying adhesive to said spray nozzle; and a controller connected between said cutting means and said valve actuator for operating said actuator in response to the cutting of said continuous rod of tobacco.

27. The cigarette maker of claim 26, wherein each adhesive strip has a length substantially aligned along the central longitudinal axis of the paper strip.

28. A cigarette comprising a tobacco rod formed of a cigarette paper having longitudinal edges and being wrapped about a tobacco filler such that an inner circumferential surface thereof confronts said tobacco filler, said tobacco rod having two ends, a filter attached at one end of the rod, a first adhesive strip sealing the longitudinal edges of said cigarette paper together and second and third adhesive strips applied on the inner circumferential surface of the paper adjacent a respective end of the tobacco rod and extending around an arcuate circumferential portion of said inner circumferential surface less than the entire inner circumferential surface of said paper.

29. A cigarette wrapping paper for forming tobacco rods having reduced loose ends comprising a web of paper having two longitudinal edges, a predetermined width between said edges and an indeterminate length, a first continuous adhesive strip applied along one of said longitudinal edges and a plurality of second spaced adhesive strips applied to said paper along only one longitudinal axis spaced from the longitudinal edges of said paper, said adhesive strips having a width less than the predetermined width of said paper and being spaced from both longitudinal edges of said paper, said second adhesive strips having a length along the longitudinal extent of the paper, the dimension between the midpoints of the lengths of adjacent second adhesive strips being substantially equal to the length of one tobacco rod.

* * * * *